US008739336B2

(12) United States Patent
Kiefer

(10) Patent No.: US 8,739,336 B2
(45) Date of Patent: Jun. 3, 2014

(54) INCLINED BODY POSITIONING AND SUPPORT SYSTEM

(71) Applicant: John Kiefer, Sweet Valley, PA (US)

(72) Inventor: John Kiefer, Sweet Valley, PA (US)

( * ) Notice: Subject to any disclaimer, the term of this patent is extended or adjusted under 35 U.S.C. 154(b) by 0 days.

(21) Appl. No.: 13/875,221

(22) Filed: May 1, 2013

(65) Prior Publication Data

US 2013/0291308 A1 Nov. 7, 2013

Related U.S. Application Data

(60) Provisional application No. 61/643,334, filed on May 6, 2012.

(51) Int. Cl.
*A47C 16/00* (2006.01)
*A47C 20/00* (2006.01)
*B68G 5/00* (2006.01)

(52) U.S. Cl.
USPC ..... 5/652.1; 5/636; 5/645; 5/653

(58) Field of Classification Search
USPC ..... 5/630–632, 636, 645, 652, 652.1, 653
See application file for complete search history.

(56) References Cited

U.S. PATENT DOCUMENTS

| | | | | | |
|---|---|---|---|---|---|
| 4,031,579 | A * | 6/1977 | Larned | 5/652.1 |
| 4,171,549 | A * | 10/1979 | Morrell et al. | 5/632 |
| D293,286 | S * | 12/1987 | Alfer | D6/596 |
| 4,951,334 | A * | 8/1990 | Maier | 5/653 |
| 5,168,590 | A * | 12/1992 | O'Sullivan | 5/490 |
| D335,235 | S * | 5/1993 | Hildreth | D6/601 |
| 5,307,532 | A * | 5/1994 | Connell | 5/643 |
| 5,317,773 | A * | 6/1994 | Graebe | 5/653 |
| 5,461,741 | A * | 10/1995 | Graebe | 5/654 |
| 5,687,436 | A * | 11/1997 | Denton | 5/653 |
| 5,778,469 | A * | 7/1998 | Festa | 5/640 |
| 5,970,546 | A * | 10/1999 | Danis | 5/636 |
| 5,978,990 | A | 11/1999 | Akey | |
| 6,049,927 | A * | 4/2000 | Thomas et al. | 5/632 |
| 6,226,817 | B1 * | 5/2001 | Rubio | 5/632 |
| 6,760,934 | B1 * | 7/2004 | Leach | 5/632 |
| 6,760,935 | B1 * | 7/2004 | Burton et al. | 5/645 |
| 6,886,201 | B1 | 5/2005 | Weiss-Lohrei | |
| 7,347,498 | B2 * | 3/2008 | Clifford | 297/452.21 |
| 7,547,071 | B2 | 6/2009 | Huffman | |
| 8,065,766 | B1 * | 11/2011 | Fierro | 5/632 |
| 2003/0000018 | A1 * | 1/2003 | Lanteri | 5/636 |
| 2006/0179572 | A1 * | 8/2006 | Rubio | 5/636 |
| 2006/0253986 | A1 * | 11/2006 | Rubio | 5/632 |
| 2007/0174970 | A1 * | 8/2007 | Best | 5/644 |
| 2007/0220678 | A1 * | 9/2007 | Ciliento | 5/636 |
| 2008/0163428 | A1 * | 7/2008 | Groteke et al. | 5/638 |
| 2009/0100596 | A1 * | 4/2009 | Weedling et al. | 5/81.1 HS |
| 2010/0146708 | A1 * | 6/2010 | Sakata et al. | 5/655.3 |
| 2012/0073055 | A1 * | 3/2012 | Cupo | 5/636 |
| 2012/0117733 | A1 * | 5/2012 | Chen | 5/652.1 |

* cited by examiner

*Primary Examiner* — William Kelleher
*Assistant Examiner* — Eric Kurilla
(74) *Attorney, Agent, or Firm* — Mitchell A. Smolow

(57) ABSTRACT

An inclined body positioning and support system is presented comprising an internal foundational wedged support encased in a chamber, an internal ventilation/comfort material encased in a chamber, first and second internal elongated positioning and support chambers each encasing a fill material, and an external cover. The foundational wedge chamber encases a respective first and second wedge plateau overlapped by the respective first and second elongated support material chamber to form a respective first and second transitional.

20 Claims, 7 Drawing Sheets

INCLINED BODY POSITIONING AND SUPPORT SYSTEM

CROSS REFERENCE TO RELATED APPLICATIONS

This application claims benefit of U.S. Provisional Application No. 61/643,334 filed May 6, 2012.

NOTICE OF COPYRIGHT AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure, as it appears in the Patent and Trademark Office patent files or records, but otherwise reserves all copyright and trade dress rights whatsoever.

FIELD OF THE INVENTION

This invention relates generally to body support and in particular, to an inclined body positioning and support system.

BACKGROUND OF THE INVENTION

Many medical afflictions hinder an individuals ability to successfully enjoy a painless, restful sleep. In some cases, body positioning and support combined with upper body elevation offer enough relief to facilitate a less painful and more restful sleep.

Often this body repositioning is accomplished with multiple pillows. However, the pillows may shift position and/or be difficult to properly place, particularly by an individual experiencing pain on movement. Persons with limited mobility mobility limiting conditions, or conditions which are relieved by elevation may not have the coordination and/or strength or may be experiencing too much pain to manipulate multiple pillows to achieve the desired positioning.

Accordingly, there is still a continuing need for improved body support designs. The present invention fulfills this need and further provides related advantages.

BRIEF SUMMARY OF THE INVENTION

In a first preferred embodiment the inclined body positioning and support system comprises an internal foundational wedged support encased in a chamber, an internal ventilation/comfort material encased in a chamber, first and second internal elongated positioning and support chambers each encasing a fill material, and an external cover.

In a second embodiment the inclined body positioning and support system comprises an internal foundational wedged support and an internal ventilation/comfort material encased in a chamber, first and second internal elongated positioning and support chambers each encasing a fill material, and an external cover.

The inclined body positioning and support system assists persons with affliction such as back pain, degenerative muscular and neurological aliments, reflux, restless leg syndrome, pregnancy, and other conditions which impact the ability of an individual to achieve and maintain a comfortable, well supported back or side sleeping position. The system also functions as a sitting, lower back support system. For example each elongated chamber can be folded across the foundational wedge to offer lower back support while sitting up, for example, in bed.

Each chamber is instrumental to providing support to assist persons with an affliction such as back pain, degenerative muscular conditions, reflux, pregnancy and other conditions which impact the ability of an individual to achieve a comfortable sleeping position in a back or side lying position.

The foundational wedge elevates an individual's head and or upper body. The ventilation/comfort material enhances air flow between the body and the foundational wedge and offers a softer transition from the firmer foundational wedge.

The first and second elongated support chambers offer side to side and front to back support for the lower extremities of the body. In a side lying position the elongated support chambers offer support between the legs and knees while also offering support to the lower back and the Gluteus Medius. In a back lying position the elongated support chambers can act as a lumbar support or can facilitate leg elevation.

Another advantage of the inclined body positioning and support system is that the system offers an integrated elevated positioning and sleeping system utilizing the wedge and elongated chambers.

Yet another advantage is that unlike known wedges the present invention includes an integral ventilation material which reduces sweating, and it comprises a softer transition from the elongated chambers to the wedge. This is important because in many circumstances persons with limited range of motion tend to remain in one position, with resultant numbness.

Exemplars of groups that would benefit from the inclined body positioning and support include pregnant women, persons experiencing back pain, persons who have degenerative muscular and neurological afflictions, persons with reflux, restless leg syndrome, and those who are rehabilitant form an injury, have limited range of motion, or need body positioning and support while sleeping.

Still another advantage is that elevation and full body support is delivered in a singular unified sleep and positioning system.

Other features and advantages of the present invention will be apparent from the following more detailed description of the preferred embodiments, taken in conjunction with the accompanying drawings and photographs which illustrate, by way of example, the principles of the invention.

BRIEF DESCRIPTION OF THE DRAWINGS

The accompanying drawings and photographs are included to provide a further understanding of the present invention. These drawings are incorporated in and constitute a part of this specification, illustrate one or more embodiments of the present invention, and together with the drawings and description, serve to explain the principles of the present invention.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it should be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention.

Figure 1:
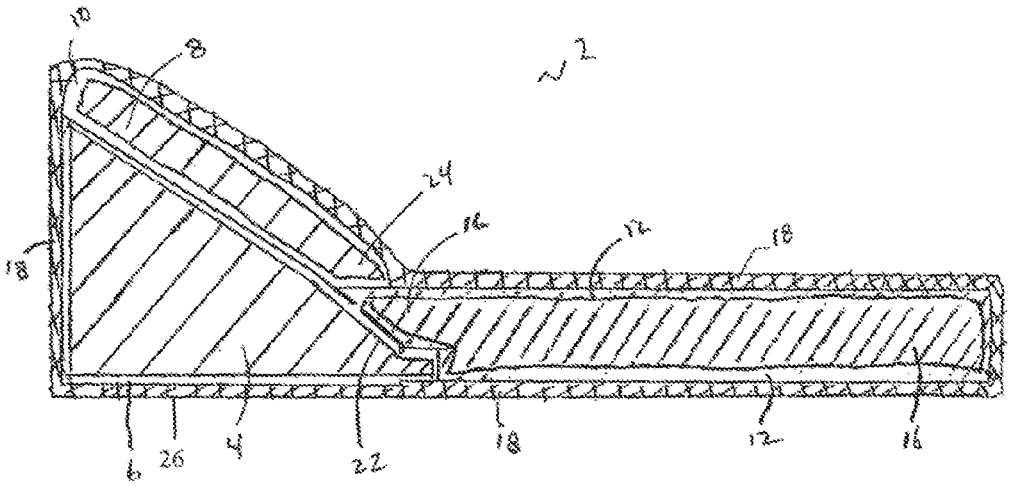
FIG. 1 is a side view of a first embodiment of the inclined body positioning and support system.
Figure 3:
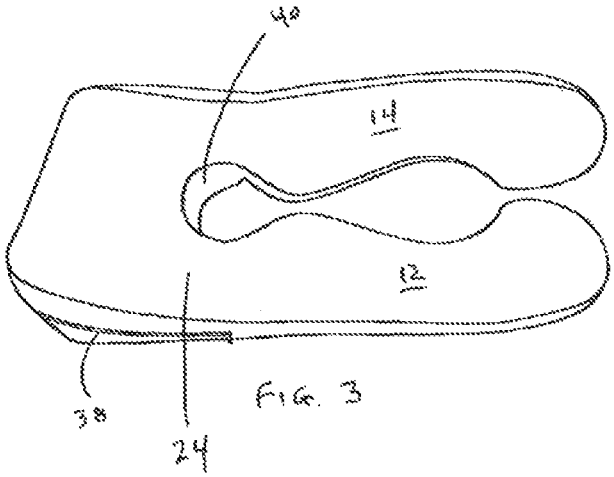
FIG. 3 is a perspective view of the inclined body positioning and support system.

Turning now to FIGS. 1 and 3, in a first preferred embodiment the inclined body positioning and support system 2 comprises five principal elements: an internal foundational wedge 4 encased in a wedge chamber 6, an internal ventilation/comfort (v/c) material encased in a v/c chamber 10, a first and second elongated positioning and support chamber 12, 14 each encasing a fill material 16, and an external cover 18.

Figure 2:
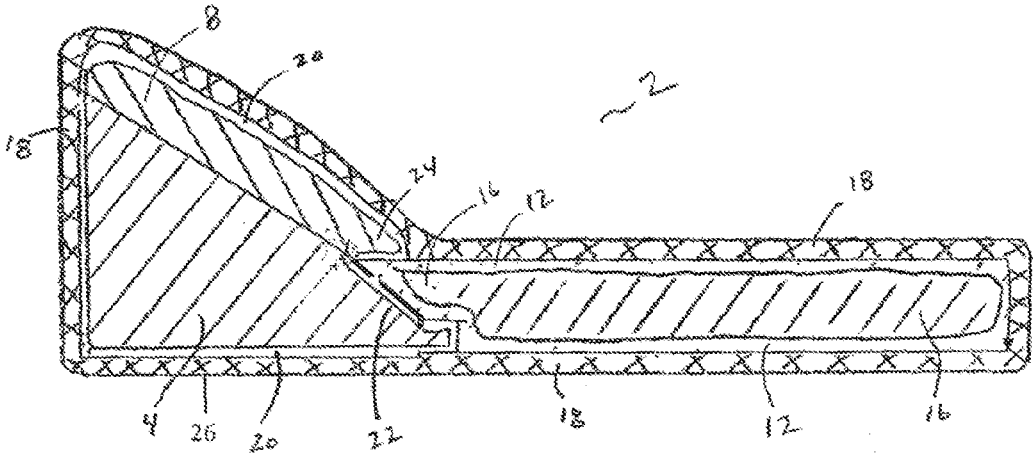
FIG. 2 is a side view of a second embodiment of the inclined body positioning and support system.

Depicted in FIGS. 2 and 3, in a second preferred embodiment the inclined body positioning and support system 2 comprises an internal foundational wedge 4 and an internal ventilation/comfort material 8 encased in a wedge/comfort material chamber 20, first and second internal elongated positioning and support chambers 12, 14 each encasing a fill material 16, and an external cover 18.

Figure 5:
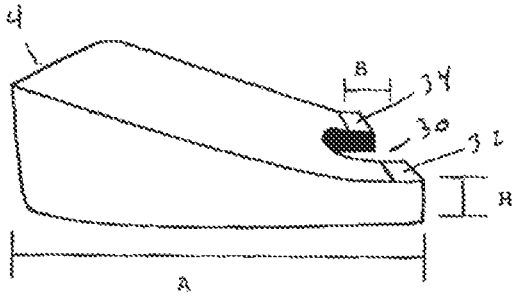
FIGS. 5 and 6 are side perspective views of the internal foundational wedge.
Figure 6:
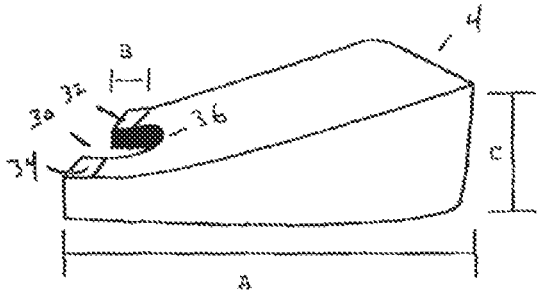
Figure 7:
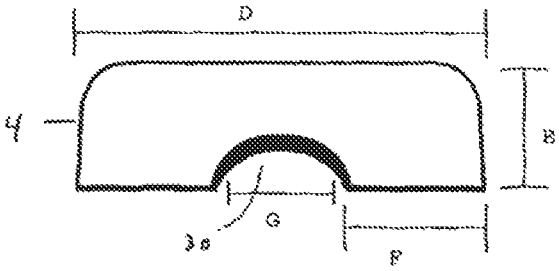
FIG. 7 is an end view of the internal foundational wedge.

Turning now to FIGS. 5-7, the internal foundational wedge 4 comprises a semi-circular cut-out 30 and a first and second plateau 32, 34 extending on each side of the cut-out 30. When the component parts are assembled, the two plateaus 32, 34 are overlapped by the first and second elongated positioning and support chambers 12, 14 (FIGS. 1 and 2). This novel geometric configuration prevents the formation of a valley where the incline 22 meets the elongated chambers 12, 14.

Figure 8:
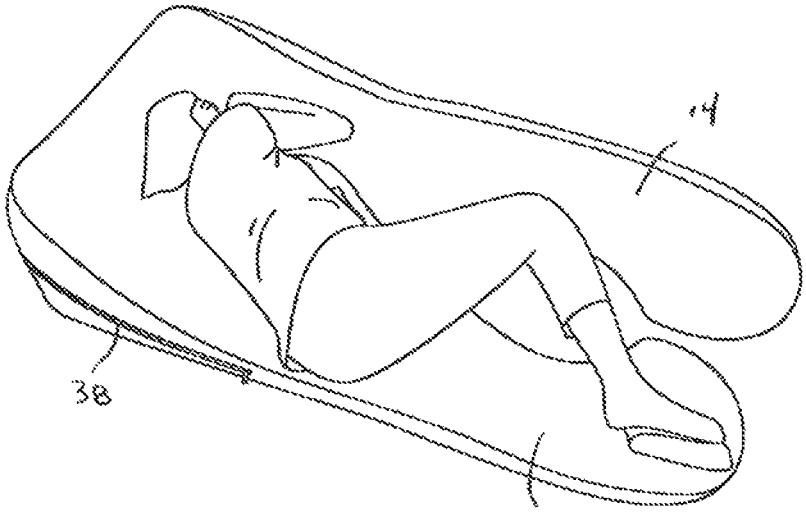
FIGS. 8 and 9 are perspective views of the inclined body positioning and support system use.
Figure 9:
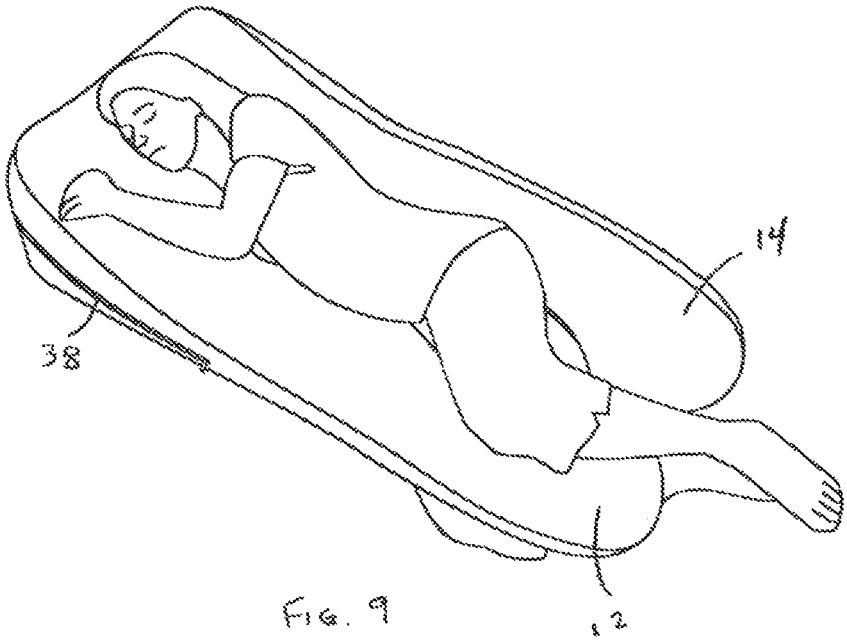

The internal foundational wedge 4 provides the opportunity to elevate a person's head and upper body as depicted in FIGS. 8 and 9. The foundational wedge leading edge 36 comprises the semi-circular cut-out 30 which allows for more comfortable sleeping, improved physiologic transition between the shoulder and neck, improved physiologic transition between the rib cage and shoulder, improved physiologic transition between the Gluteus Medius and lower back transition (depending on height), and improved physiologic sitting.

The system is designed to also work as a sitting based work or reading station. The foundational wedge bottom side 26 (FIGS. 1 and 2), which does not include the internal ventilation/comfort material 8, and is, therefore, a firm surface, is fabricated to be a substantially flat surface to serve as a substantially firm work or reading surface. When used in this fashion, the foundational wedge bottom side 26 is facing up and the v/c chamber 10 is placed on the knees and lap. The first and second elongated chambers 12, 14 may be wrapped around the lower back for additional support.

The internal ventilation/comfort material 8, whether encased in its own chamber 10 (first embodiment, FIG. 1) or encased in a single chamber 20 with the foundational wedge 4 (second embodiment, FIG. 2) offers innovative features such as better air flow. Known foam wedge designs lack air flow, consequently persons using these known wedge designs experience increased perspiration and/or become very warm. The internal ventilation/comfort material 8 sits on top of the foundational wedge 4 (either encased in a separate chamber, FIG. 1, or directly upon the foundational wedge 4, FIG. 2) to promote air flow between the foundational wedge 4 and the person, thereby reducing or eliminating the perspiration/excess warmth problem.

The system 2 is advantageous for those who have limited mobility. It is important to include a transitional 24 from the softer elongated chambers 12, 14 to the firmer foundational wedge 4. Extended sleep on a firm support system transitional 24 may cause numbness. The ventilation/comfort material 8 and its chamber 10, 20 provides this transitional 24.

The first and second elongated positioning and support chambers 12, 14 and their fill material 16, are preferably diametrically opposed and provide extended positioning elements for support below the shoulders. Depicted in FIGS. 8 and 9, when a person is lying on a side, one elongated positioning and support chamber 12, 14 provides support for the spine, lower back, Gluteus Medius and knees. The other elongated positional and support chamber 12, 14 provides support for the arms, midriff, thighs and knees. When a person is lying on the back (not shown), both elongated positional and support chambers 12, 14 will offer side to side support and/or they may be used to prop up the knees.

The internal chambers 6 or 20, 10, 12, 14 are affixed to one another, for example, sewn together, which provides maximum effective support and comfort. The external cover 18 is removable, preferably through use of a zipper 38, and along with the internal chambers 6 or 20, 10, 12, 14 fixation, the external cover 18 adds support to the affixed chambers 6 or 20, 10, 12, 14 it overlays.

As depicted in FIGS. 1 and 2, the foundational wedge 4 may be encased in its own chamber 6 with all other chambers filled with known fill material 16, for example, known pillow filling material; or alternatively, the foundational wedge 4 and internal ventilation/comfort material 8 are encased in a single chamber 20 with all other chambers filled with known filling material 16, for example, known pillow filling material. In either case, the internal ventilation/comfort material 8 is a fill material that allows effective therapeutic air flow.

As described above, in constructing the system 2, in a preferred embodiment, all chambers 6 or 20, 10, 12, 14 are affixed to one another, for example, sewn together prior to fill. To prevent formation of a valley, the first and second elongated positioning and support chambers 12, 14 are sewn to overlap the portion of the wedge chamber 6 or wedge/comfort material chamber 20 that will contain the plateaus 32, 34. Once the chambers 6 or 20, 10, 12, 14 have been sewn together, the foundational wedge 4 is inserted into its chamber 6 or 20 and fill material 16 is inserted, for example, blown, into all remaining chambers 10, 12, 14. Each chamber 6 or 20, 10, 12, 14 is sealed, for example, sewn shut, to completely encase its foundational wedge 4 and fill material 16. The constructed chambers 6 or 20, 10, 12, 14 are then inserted into the external cover 18 which is then sealed, for example, zippered shut.

Figure 4:
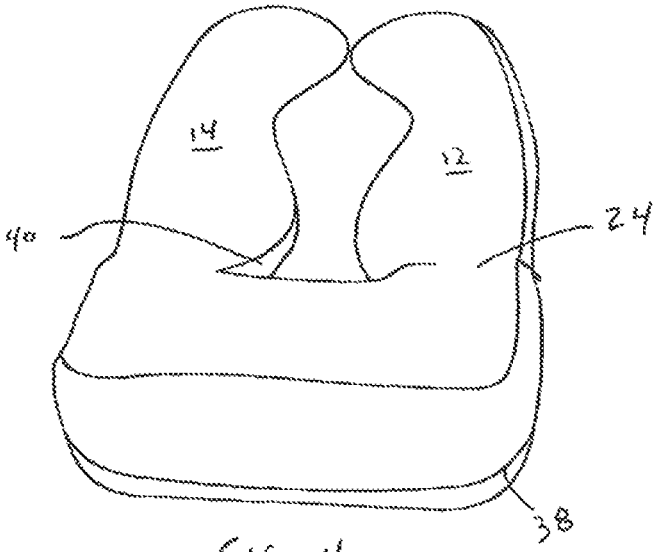
FIG. 4 is an end perspective of the inclined body positioning and support system.

The external cover 18 comprises a gusseted seam 40 (FIGS. 3 and 4) in the area of the semi-circular cut-out 30. The gusseted seam 40 provides a more comfortable transition from the shoulder to the neck when lying or for a more comfortable lumbar transition when sitting.

Returning to FIGS. 5-7, though not absolute, but rather as exemplars, in a preferred embodiment the foundational wedge rise C is about 5 to about 15 inches, preferably about 8¾ inches, and the foundational wedge run A is about 9 inches to about 29 inches, preferably about 19⅓ inches. At its deepest portion, the gusseted seam 40 is about 1½ inches to about 7 inches, preferably about 3 inches in height. The foundational wedge 4 width D is about 15 inches to about 40 inches, preferably about 30 inches.

Each plateau 32, 34 is about 1½ inches to about 5 inches in length, preferably about 2¼ inches in length B and about 1 inch to about 5 inches, preferably about 2 inches in height H. The semicircular cut-out 30 is about 8 inches to about 16 inches, preferably about 12¼ inches at it widest point G and about 3 inches to about 10 inches, preferably about 6¼ inches deep.

Each first and second elongated positioning and support chamber 12, 14 is about 33 inches to about 43 inches, preferably about 38 inches in length and has a predetermined geometric shape to and in obtaining physiologic comfort. Each first and second elongated positioning and support chamber 12, 14 may be mirror images of one another or they may base different geometric shapes and/or lengths from one another.

As depleted in FIGS. 10-13, it is also contemplated that the system may be designed to have two different foundational wedge angulations as measured from horizontal, indicated by dashed line 30, rather than a firm bottom work surface. The varied foundational wedge angulations are accessible by merely flipping the system so that the bottom surface becomes the top surface.

Figure 10:
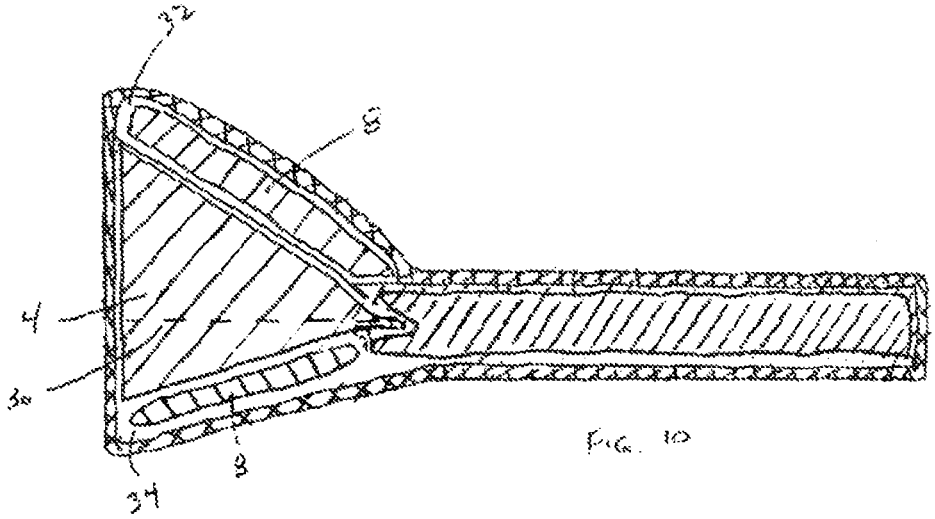
FIGS. 10 to 13 are side views of alternate embodiments of the inclined body positioning and support system.
Figure 11:
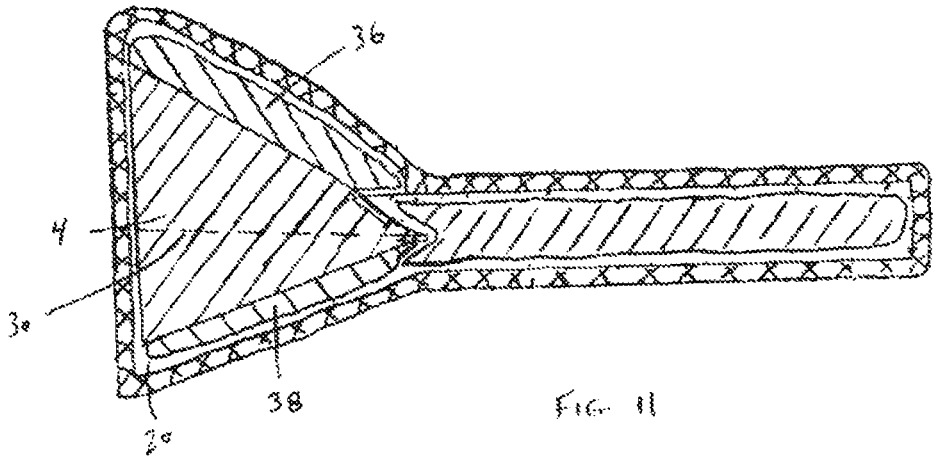

FIGS. 10 and 11 achieve the two different foundational wedge angulations by fabricating the foundational wedge 4 to a predetermined geometric shape that provides two different wedge angulations as measured from horizontal 30. FIG. 10 depicts an embodiment having a first and second ventilation/comfort material chamber 32, 34 each containing ventilation/comfort material 8. FIG. 11 depicts a first and second ventilation/comfort material 36, 38 contained within a wedge/comfort material chamber 20. In all other aspects the system is as described above.

Figure 12:
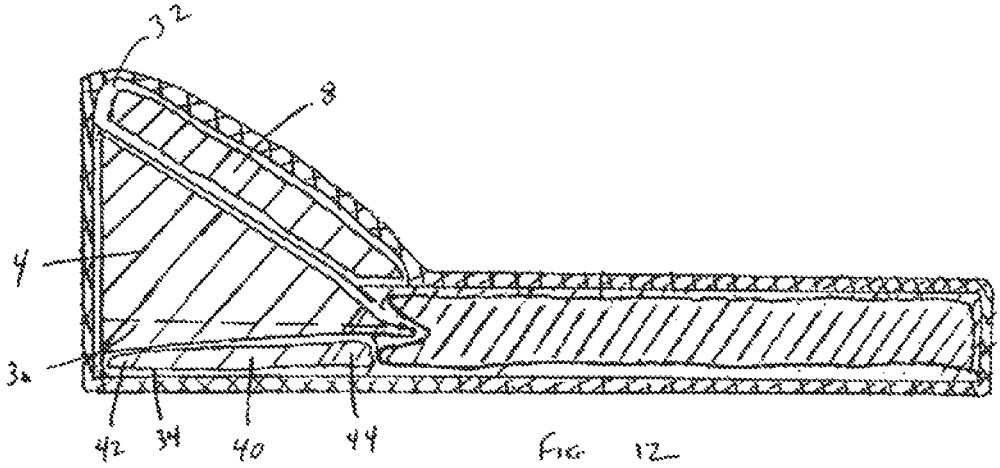
Figure 13:
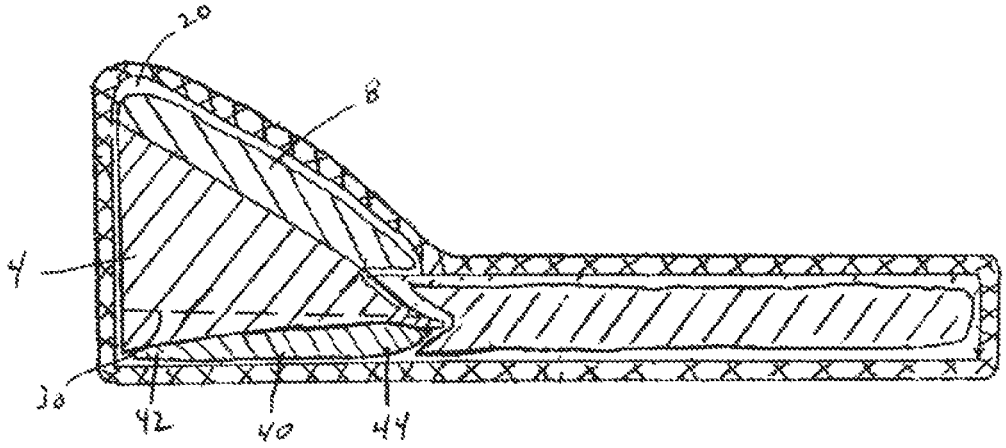

FIGS. 12 and 13 achieve the two different foundational wedge angulations by fabricating the foundational wedge 4 to a predetermined geometric shape in combination with a bottom ventilation/comfort material 40 having a thinner first end 42 relative to a thicker second end 44. FIG. 12 depicts an embodiment having a first and second ventilation/comfort material chamber 32, 34 containing ventilation/comfort material 8, 40, respectively. FIG. 13 depicts a first and second ventilation/comfort material 8, 40 contained within a wedge/comfort material chamber 20. In all other aspects the system is as described above.

Although the present invention has been described in connection with specific examples and embodiments, those skilled in the art will recognize that the present invention is capable of other variations and modifications within its scope. For example, while specific inch measurement have been given for a preferred embodiment, the system is not envisioned to be limited to those measurements.

These examples and embodiments are intended as typical of, rather than in any way limiting on, the scope of the present invention as presented in the appended claims.

What is claimed is:

1. An inclined body positioning and support system comprising:

an internal foundational wedge encased in a foundational wedge chamber;

an internal ventilation/comfort material encased in a ventilation/comfort chamber overlaying the foundational wedge chamber;

a first and second elongated positioning and support material each encased in a respective first and second elongated support material chamber; and an external cover;

wherein the first and second elongated support material chambers each overlap a portion of the foundational wedge chamber forming a respective first and second transitional.

2. The inclined body positioning and support chamber of claim 1 wherein the foundational wedge chamber encases a respective first and second wedge plateau overlapped by the respective first and second elongated support material chamber to form the respective first and second transitional.

3. The inclined body positioning and support system of claim 2 wherein the first and second wedge plateau extend from a respective first and second side of a semi-circular cut-out contained within a wedge support leading edge.

4. The inclined body positioning and support system of claim 2 wherein a foundational wedge bottom side comprises a substantially flat, substantially firm surface.

5. The inclined body positioning and support system of claim 3 wherein a foundational wedge bottom side comprises a substantially flat, substantially firm surface.

6. The inclined body positioning and support system of claim 2 wherein the first and second elongated support material chambers are diametrically opposed.

7. The inclined body positioning and support system of claim 5 wherein the first and second elongated support material chambers are diametrically opposed.

8. The inclined body positioning and support system of claim 1 wherein all chambers are sewn together prior to being filled and then sealed individually after being filled, thereafter encased by the cover.

9. The inclined body positioning and support system of claim 7 wherein the external cover comprises a semi-circular cut-out gusseted seam.

10. The inclined body positioning and support system of claim 9 wherein a foundational wedge rise is about 5 to about 15 inches; a foundational wedge run is about 9 to about 29 inches; the gusseted seam is about ½ to about 7 inches in height at its deepest portion; a foundational wedge width is about 15 to about 40 inches; each plateau is about 1½ to about 5 inches in length and about 1 to about 5 inches in height; the semi-circular cut-out is about 8 to about 16 inches at its widest point and about 3 to about 10 inches deep; and each elongated positioning and support chamber is about 33 to about 43 inches in length, comprising a predetermined physiologic comfort obtaining geometric shape.

11. An inclined body positioning and support system comprising:

an internal foundational wedge overlaid by an internal ventilation/comfort material, together encased in a wedge/comfort material chamber;

a first and second elongated positioning and support material each encased in a respective first and second elongated support material chamber; and an external cover;

wherein the first and second elongated support material chambers each overlap a portion of the wedge/comfort material chamber forming a respective first and second transitional.

12. The inclined body positioning and support chamber of claim 11 wherein the wedge/comfort material chamber encases a respective first and second wedge plateau overlapped by the respective first and second elongated support material chamber to form the respective first and second transitional.

13. The inclined body positioning and support system of claim 12 wherein the first and second wedge plateau extend from a respective first and second side of a semi-circular cut-out contained within a wedge support leading edge.

14. The inclined body positioning and support system of claim 12 wherein a foundational wedge bottom side comprises a substantially flat, substantially firm surface.

15. The inclined body positioning and support system of claim 13 wherein a foundational wedge bottom side comprises a substantially flat, substantially firm surface.

16. The inclined body positioning and support system of claim 12 wherein the first and second elongated support material chambers are diametrically opposed.

17. The inclined body positioning and support system of claim 15 wherein the first and second elongated support material chambers are diametrically opposed.

18. The inclined body positioning and support system of claim 11 wherein all chambers are sewn together prior to being filled and then sealed individually after being filled, thereafter encased by the cover.

19. The inclined body positioning and support system of claim 17 wherein the external cover comprises a semi-circular cut-out gusseted seam.

20. The inclined body positioning and support system of claim 19 wherein a foundational wedge rise is about 5 to about 15 inches; a foundational wedge run is about 9 to about 29 inches; the gusseted seam is about ½ to about 7 inches in height at its deepest portion; a foundational wedge width is about 15 to about 40 inches; each plateau is about 1½ to about 5 inches in length and about 1 to about 5 inches in height; the semi-circular cut-out is about 8 to about 16 inches at its widest point and about 3 to about 10 inches deep; and each elongated positioning and support chamber is about 33 to about 43 inches in length, comprising a predetermined physiologic comfort obtaining geometric shape.

* * * * *